United States Patent [19]

Esterson et al.

[11] Patent Number: 4,728,860

[45] Date of Patent: Mar. 1, 1988

[54] SLIDABLE SEAL FOR KLYSTRON VACUUM TUBES

[75] Inventors: Maurice Esterson, Chelmsford; Jennifer Harley nee May, Leigh-on-Sea, both of England

[73] Assignee: English Electric Valve Company Limited, Chelmsford, England

[21] Appl. No.: 831,522

[22] Filed: Feb. 20, 1986

[30] Foreign Application Priority Data

Mar. 14, 1985 [GB] United Kingdom ..... 8506610

[51] Int. Cl.[4] ..... H01J 7/46; H01J 19/80

[52] U.S. Cl. ..... 315/39; 315/39.53; 315/39.77; 315/40; 315/3; 315/4; 315/5; 228/178; 228/179; 174/50.61; 174/50.63

[58] Field of Search ..... 315/3, 4, 5, 32, 40, 315/39, 39.53, 39.77; 313/364; 333/219, 227, 232, 233; 53/DIG. 3; 228/178, 179, 903; 174/50.61, 50.63

[56] References Cited

U.S. PATENT DOCUMENTS 3,125,698 3/1964 Persson ..... 313/220

FOREIGN PATENT DOCUMENTS 768596 2/1957 United Kingdom .
784742 10/1957 United Kingdom .

*Primary Examiner*—David K. Moore
*Assistant Examiner*—Michael J. Nickerson
*Attorney, Agent, or Firm*—Spencer & Frank

[57] ABSTRACT

An external cavity klystron vacuum tube has a ceramic cylindrical wall surrounded by an external cavity within which is an output probe. The cylindrical wall section is sealed at its ends to other components of the tube—to enable the interior to be evacuated—by sealing means such as to avoid a sharp edge projecting inwardly towards the interior of the cavity.

19 Claims, 4 Drawing Figures

SLIDABLE SEAL FOR KLYSTRON VACUUM TUBES

BACKGROUND OF THE INVENTION

This invention relates to klystron vacuum tubes and in particular to so called external cavity klystron vacuum tubes.

Part of a typical external cavity klystron vacuum tube arrangement as at present known is illustrated in FIG. 1.

Referring to FIG. 1 the tube comprises a vacuum wall section 1 in the form of a dielectric cylinder transparent to electro-magnetic radiation. This forms a window through which power is effectively transmitted. The cylindrical section 1 has, at either end, cylindrical copper annuli 2,3 which are shaped to receive the ends of the cylindrical wall member 1 and provide, by portions of increased diameter, contact for spring fingers 4 attached to the inner rims of a box member 5 surrounding the cylindrical wall 1 and forming the external cavity. In order to adjust the resonant frequency of the external cavity, a pair of moveable tuning plungers (extending at right angles to the plane of the paper and not shown) is provided, one on each side of the cylindrical wall member 1. To the left (as shown) of the cylindrical wall member 1 is a coupling loop 7, adjustable by rotation, by which output power is coupled to an external transmission line and aerial (not shown).

Particular attention should be given to the method of forming the vacuum seal between the cylindrical wall member 1 and the copper annuli 2,3. Since the cylindrical wall member 1 is normally of a high purity alumina or beryllia ceramic consistent with its function as a window, there will be observed a differential expansion between the cylindrical member 1 and the copper annuli 2,3. The coefficient of expansion of the material of the cylindrical wall member 1 is very much less than that of copper.

In order to accommodate for this differential expansion the joint between the cylindrical wall member 1 and each of the copper annuli 2,3 is normally as shown in more detail in FIG. 2.

Referring to FIG. 2 it will be seen that the cylindrical wall member 1 is located within a recess 8 in the copper annulus 3 (with a similar arrangement at the other end of the member 1). Use is made of an inner cylindrical flare 9 and an outer cylindrical flare 10. Inner flare 9 is brazed at one end 11 between the end of the ceramic wall member 1 and a ceramic balance ring member 12. The outer flare member 10 is brazed to the outermost wall of the recess 8 in the copper annulus 3. Finally the vacuum seal is completed by welding inner flare member 9 to outer flare member 10.

The whole construction forms a vacuum joint with the balance ring 12 pressing against the copper disc 3 and taking up the axial thrust due to the external pressure when the tube is under vacuum. In addition the balance ring 12 forms a sliding abutment with the base of the recess 8 accommodating for differential expansion between the cylindrical wall member 1 and the copper disc 3.

It has been found that a klystron constructed as described with reference to FIGS. 1 and 2 suffers from a serious defect. The output cavity 5 operates at the highest power level and the peak radio frequency voltage across the cavity is approximately the same as the operating voltage of the klystron, typically between 20 and 26 kV for a high power television klystron. It has been found that arcing sometimes occurs in the cavity which not only can cause puncturing of the seal provided by the flares 9 and 10 but also, of course, interruption of operation if, as is commonly the case, an arc detector is introduced which removes the r.f drive from the klystron upon the detection of an arc.

The present invention seeks to provide an improved construction in which the aforementioned problem is mitigated.

SUMMARY OF THE INVENTION

According to this invention an external cavity klystron vacuum tube comprises a cylindrical section of wall which is transparent to electro-magnetic radiation and provided to be surrounded by an external resonant cavity, said cylindrical wall section having an end closed by an annulus which, towards its outer periphery, has an annular recess, and wherein a flexible ring forming part of a sealing means sealed to said annulus is secured between the end of said cylindrical wall section and a balance ring member which bears upon the base of said recess, said flexible ring having a rim formed as a radiused flange extending into said recess.

Preferably said flexible ring is secured between said cylindrical wall section and said balance ring member by brazing.

In one embodiment of the invention said radiused flange is secured around its periphery to a wall of said recess, normally the outermost wall of said recess. Normally also said flexible ring is attached to said wall of said recess by brazing.

In another construction, an external cavity klystron vacuum tube comprises a cylindrical section of wall which is transparent to electro-magnetic radiation and provided to be surrounded by an external resonant cavity, said cylindrical wall section having an end closed by an annulus upon the surface of which, towards its outer periphery, a balance ring member bears, and wherein a flexible ring forming part of a sealing means sealed to said annulus is secured between the end of said cylindrical wall section and said balance ring member, said annulus having a step at its outer periphery and the inner rim of a further flexible ring is secured to the base of said step while the outer rim thereof is turned over the outer edge of said annulus away from the interior of said cavity, the outer rim of said first-mentioned flexible ring being also turned over the outer edge of said annulus away from the interior of said cavity to form a radiused flange and the outer edges of said two ring members being united. Preferably the outer edges of said two ring members are united by welding.

Preferably a collar is provided attached to said annulus and extending over the outer rim of said first-mentioned flexible ring said collar with a like collar at the other end of said cylindrical wall section providing abutments for the walls forming an external cavity. Preferably again the walls of said external cavity terminate in spring fingers which bear upon said collars.

Preferably said cylindrical wall member and said balance ring member are of ceramic material.

Preferably the or each flexible ring is of cupro-nickel.

Preferably said annulus is of copper.

DESCRIPTION OF THE PREFERRED EMBODIMENTS

The invention is further described with reference to FIGS. 3 and 4 of the accompanying drawings which illustrate two different klystron vacuum tubes in accordance with the present invention.

Figure 2:
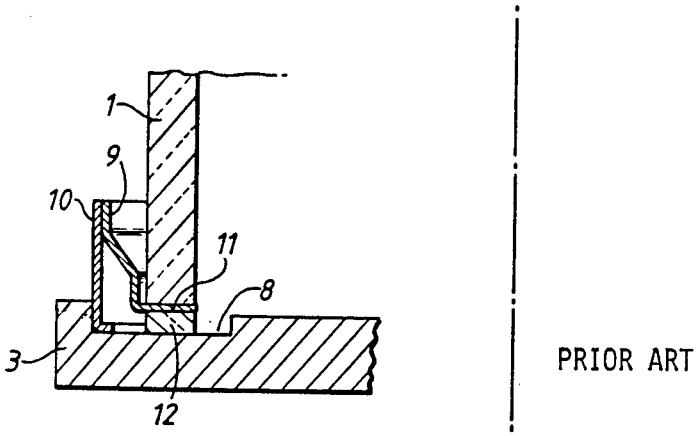
FIG. 2 shows a detail of the conventional tube of FIG. 1.
Figure 3:
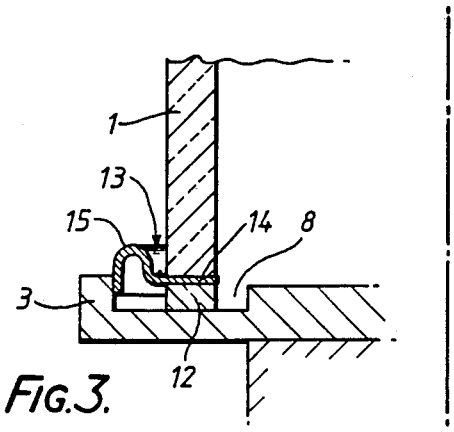
FIG. 3 illustrates a first embodiment of the present invention.

Referring to FIG. 3, this illustrates a detail of the vacuum sealing means provided in one embodiment of the present invention in the way that FIG. 2 illustrates the sealing means employed in the conventional tube, and like references are used for like parts.

Figure 1:
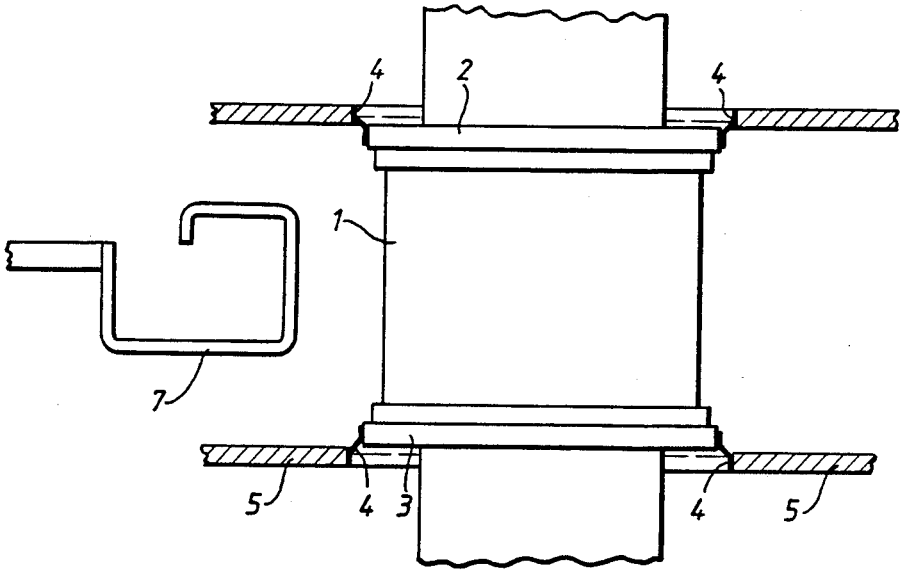
FIG. 1 illustrates a conventional external cavity klystron vaccum tube.

It will be seen that in the embodiment of the invention illustrated an edge between an inner and outer flare projecting inwardly towards the interior of the external cavity 5 and the coupling loop 7, is avoided. Investigation suggested that it was this edge features of the known construction illustrated in FIGS. 1 and 2 which tended to provoke arcing and thus the problems outlined hereinbefore. With the known construction of FIGS. 1 and 2 the electric field in the cavity tended to be concentrated at the welded edge of the inner and outer flares and high electric fields tended to be set up between the welded edge of the flares and the output loop 7 by means of which the power is coupled to an external transmission line and, subsequently, an aerial.

In the construction illustrated in FIG. 3 the seal is effected by means of an annular ring 13 of cupro-nickel the inner rim 14 of which is secured between the cylindrical wall member 1 and the balance ring 12 by brazing. The outer rim 15 of the annular ring is formed into a radiused flange and the "turned-over" periphery is secured within the recess 8 to the outermost wall or flange thereof. With this arrangement it will be seen that there is no edge projecting inwardly of the cavity 5. The smooth rounded surface presented by the flange outer rim 15 of the annular ring is not such as to induce arcing. At the same time the radiused configuration provides the degree of flexibility required to accommodate for the effects of differential expansion.

Figure 4:
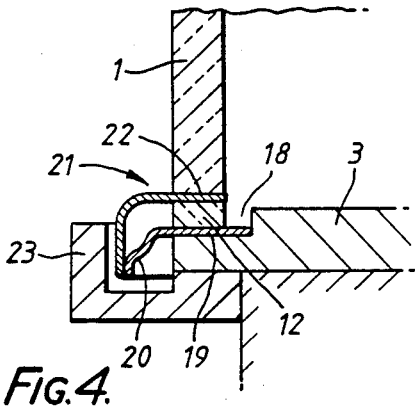
FIG. 4 is a second embodiment of the invention.

Referring to FIG. 4, in this embodiment the copper annulus 3 has a step 18 at its outer periphery and the inner rim 19 of a flexible cupro-nickel ring 20 is brazed to the base of the step 18 to form a seating for the balance ring 12. The outer periphery of the cupro-nickel ring 20 is turned down (as viewed) over the edge of annulus 3 and away from the interior of the external cavity 5. A thin cupro-nickel ring 21 has its inner rim 22 secured by brazing between the cylindrical wall member 1 and the balanced ring 12. The outer rim of the ring 21 is also turned down (as viewed) over the edge of annulus 3 away from the interior of the external cavity 5 to meet the external periphery of the ring 20. The edge thus formed is welded to complete the required vacuum joint. To provide a suitable contact for the spring fingers 4 of the box section forming the cavity 5 (which should not bear on the surface of the ring 21 because of the risk of burning at the finger contact and consequent puncturing of the ring), a copper collar 23 is fitted around the sealing ring 21. Copper collar 23 is fitted either by means of a screw thread or it is soldered to the underside (as viewed) of the copper annulus 3. While in many ways this construction is reminiscent of that illustrated in FIG. 2, nevertheless it will be appreciated that the welded edge uniting the outside peripheries of the rings 20,21 does not extend inwardly towards the interior of the cavity 5, a smoothly rounded surface being presented in that direction.

We claim:

1. An external cavity klystron vacuum tube, comprising a cylindrical section including a wall transparent to electromagnetic radiation and surrounded by an external resonant cavity, said wall having an end portion;

an annular section positioned adjacent the end portion of said wall said annular section having at its outer periphery an annular recess provided with a bottom surface and opposing outer and inner flanges;

a balance ring member interposed between the end portion of said wall and the bottom surface of said annular recess, said balance ring being spaced from the opposing flanges of said recess; and a flexible ring having one end sealed to the outer flange of said recess and the other end interposed between the end portion of said wall and said balance ring member, said ring having a U-shaped portion between the ends thereof whereby said balance ring member is slidable in a direction parallel to said bottom surface of said recess and between said flanges, and the U-shaped portion of said ring inhibits arcing.

2. A tube as claimed in claim 1 and wherein said flexible ring is secured between said cylindrical wall section and said balance ring member by brazing.

3. A tube as claimed in claim 1 and wherein said flexible ring is attached to said wall of said recess by brazing.

4. A tube as claimed in claim 1 and wherein the wall of said cylindrical section and said balance ring member are made of ceramic material.

5. A tube as claimed in claim 1 and wherein said flexible ring is made of cupro-nickel.

6. A tube as claimed in claim 1 and wherein said annular section is made of copper.

7. A tube as claimed in claim 3 and wherein said cylindrical wall member 1 and said balance ring member 3 are made of ceramic material.

8. A tube as claimed in claim 2 and wherein said flexible ring is made of cupro-nickel.

9. A tube as claimed in claim 3 and wherein said flexible ring is made of cupro-nickel.

10. A tube as claimed in claim 3 and wherein said annulus is made of copper.

11. An external cavity klystron vacuum tube comprising a cylindrical section of wall which is transparent to electro-magnetic radiation and surrounded by an external resonant cavity, said cylindrical wall section having an end closed by an annulus upon the surface of which, towards its outer periphery, a balance ring member bears, and wherein a first flexible ring forming part of a sealing means sealed to said annulus is secured between the end of said cylindrical wall section and said balance ring member, said annulus having a step at its outer periphery and the inner rim of a second flexible ring is secured to the base of said step while the outer rim of said second flexible ring is turned over the outer edge of said annulus away from the interior of said cavity, the outer rim of said first flexible ring being also turned over the outer edge of said annulus away from the interior of said cavity to form a radiused flange and the outer edges of said two ring member being united.

12. A tube as claimed in claim 11 and wherein the outer edges of said two ring members are united by welding.

13. A tube as claimed in claim 11 and wherein a collar is provided attached to said annulus and extending over the outer rim of said first-mentioned ring, said collar with a like collar at the other end of said cylindrical wall section providing abutments for the walls forming an external cavity.

14. A tube as claimed in claim 13 and wherein the walls of said external cavity terminate in spring fingers which bear upon said collars.

15. A tube as claimed in claim 11 and wherein at least one of said first and second flexible rings is made of cupro-nickel.

16. A tube as claimed in claim 12 and wherein at least one of said first and second flexible rings is of cupro-nickel.

17. A tube as claimed in claim 11 and wherein said first flexible ring is secured between said cylindrical wall section and said balance ring member by brazing.

18. A tube as claimed in claim 11 and wherein said cylindrical section of wall and said balance ring member are made of ceramic material.

19. A tube as claimed in claim 11 and wherein said annulus is made of copper.

* * * * *